US005083798A

United States Patent [19]

Massey

[11] Patent Number: 5,083,798

[45] Date of Patent: Jan. 28, 1992

[54] EXPANDABLE BROADHEAD FOR AN ARROW

[76] Inventor: Douglas J. Massey, Apt. 24, 1628 Brookdale Rd., Naperville, Ill. 60540

[21] Appl. No.: 743,716

[22] Filed: Aug. 12, 1991

[51] Int. Cl.[5] ..... F42B 6/08

[52] U.S. Cl. ..... 273/421

[58] Field of Search ..... 273/421, 422, 416

[56] References Cited

U.S. PATENT DOCUMENTS

| | | | |
|---|---|---|---|
| 2,859,970 | 11/1958 | Doonan | 273/421 |
| 3,138,383 | 6/1964 | McKinzie | 273/421 |
| 4,504,063 | 3/1985 | LeBus | 273/422 |
| 4,932,671 | 6/1990 | Anderson, Jr. | 273/421 |
| 4,973,060 | 11/1990 | Herzing | 273/421 |
| 4,998,738 | 3/1991 | Dockett | 273/421 |

FOREIGN PATENT DOCUMENTS

| | | | |
|---|---|---|---|
| 2029711 | 3/1980 | United Kingdom | 273/416 |

*Primary Examiner*—Paul E. Shapiro
*Attorney, Agent, or Firm*—Robert L. Marsh

[57] ABSTRACT

A broadhead has an elongate body with an axial cavity and a plurality of longitudinal slots are spaced radially through the wall of the body and a blade is disposed in each of the longitudinal slots. Each of the blades is pivotally mounted at the end nearest the tip so that they may selectively pivot through the slot from a retracted position or an extended position. Each blade has a cam edge which fits within the slot associated with the blade when the blade is pivoted into the retracted position. A slug is adapted to slide within the longitudinal cavity of the body and engage the cams of the blades when the blades are in the retracted positions and cause the blades to project outwardly as the slug moves forward within the cavity from a starting position adjacent to the shaft end of the body. A hook is also provided on each of the blades and a catch engages the hooks on the blades and retains them in the retracted position when the slug is positioned adjacent to the shaft end of the cavity. In the preferred embodiment, the slug is magnetized and a second magnet polarized to attract the slug is positioned at the end of the cavity adjacent the arrow shaft. The blades are made of a magnetic material such as steel and the body is made of a nonmetallic material such as aluminum.

10 Claims, 1 Drawing Sheet

EXPANDABLE BROADHEAD FOR AN ARROW

The present invention relates generally to broadhead tips for arrows, and specifically to broadheads having blades which can be retracted during the flight of the arrow and move to a projected position upon impact of the arrow with a target.

BACKGROUND OF THE INVENTION

Hunters who hunt with a bow and arrow under certain circumstances desire to use a broadhead type arrowhead which has a plurality of radially extending longitudinally oriented blade edges spaced around the circumference of the arrowhead. The blades of the broadhead create a wider wound in the hunted animal and therefore improve the arrows effectiveness in making a kill. It is therefore desirable to maximize the distance that the blades extend outwardly from the shaft of an arrow so as to cause a correspondingly wider wound. Furthermore, the effectiveness of a broadhead is enhanced by the number of blades which are provided, and therefore broadheads typically have at least three blades, and may have as many as six blades.

Broadheads tend to reduce the accuracy of an arrow compared to other arrowheads because transverse air movements catch the enlarged surface areas of the blade during flight and cause the arrow to appear to drift, that is, not fly directly at its intended target. Openings are provided in the sides of the blades to reduce the surface area of the blades and therefore reduce the drifting of arrows fitted with broadheads. Also several attempts have been made to construct a broadhead with blades which will be at least partially retracted in flight but which will extend further outward on impact. Such prior efforts are best shown in U.S. Pat. No. 3,138,383, U.S. Pat. No. 4,973,060, U.S. Pat. No. 4,504,063, and U.S. Pat. No. 4,998,738. These prior efforts have resulted in an arrowhead having either a plunger extending longitudinally through the arrowhead from the point or having a body portion which is adapted to slide longitudinally backward relative to the shaft of the arrow on impact. Depression of the plunger or the backward motion of the arrowhead along the shaft causes the blades to be projected from a retracted position to an extended position.

Frequently the blades of arrowheads constructed as previously described tend to at least partially extend upon release of the arrow from the bow because of the inertia of the plunger or slidable arrowhead. When the arrow is accelerated by the bow, the stationary inertia of the plunger, or of the broadhead itself as the case may be, will create a force similar to the force caused on impact of the arrow and urge the blades outwardly. Arrows also have a tendency to rotate during flight, and the centrifical force caused by the rotation of the arrow during flight may also cause the blade to extend outwardly.

Furthermore, existing expandable broadheads do not have a means for retaining the blades in their retracted position until such time as the arrow impacts on the target. Consequently, one or more of the blades may move to the extended position as a result of shaking or movement of the arrow as the hunter prepares for a shot. In such cases, the existance of the expandable broadhead may cause the hunter to loose an opportune shot at a target.

It is therefore desirable to provide a broadhead having blades which can be locked in a retracted position while the hunter prepares to shoot and during the acceleration and flight of the arrow, but will extend further outwardly upon impact with a target.

BRIEF DESCRIPTION OF THE INVENTION

Briefly, the present invention is embodied in a broadhead having an elongated body with an axially oriented longitudinal cavity therein. One end of the body is provided with a tip and the other end of the body is adapted to attach to the shaft of an arrow. A plurality of longitudinal slots are spaced radially through the wall of the body and a blade is disposed in each of the longitudinal slots. Each of the blades is pivotally mounted at the end nearest the tip so that they may selectively pivot through the slot from a retracted position or an extended position. Each blade has a cam edge which fits within the slot associated with the blade when the blade is pivoted into the retracted position. A slug which in the preferred embodiment is cylindrical in shape is adapted to slide within the longitudinal cavity of the body. The forward end of the slug is adapted to engage the cams of the blades when the blades are in the retracted positions and cause the blades to project outwardly as the slug moves forward within the cavity from a starting position adjacent to the shaft end of the body.

An important features of the present invention is a hook on each of the blades. A catch, which in the preferred embodiment is an annular ridge around the circumference of the rear end of the slug, engages the hooks on the blades and retains them in the retracted position when the slug is positioned adjacent to the shaft end of the cavity. In the preferred embodiment the slug is magnetized and a second magnet polarized to attract the slug is positioned at the end of the cavity adjacent the arrow shaft. The blades are made of a magnetic material, such as steel, and the body is made of a nonmetallic material such as aluminum.

When the blades are in the retracted position and the slug is positioned adjacent the shaft end of the cavity with the hooks on the blades retained within the ridge, the slug will be retained at the shaft end of the cavity by the attraction of the magnetic slug to the hooks of the blades and to the second magnet. When the arrow is released from the bow, acceleration will not create an internal force tending to cause the blades to move to the extended position, and the ridge on the slug will retain the blades in the retracted position against centrifical force during the flight of the arrow. On impact, however, the deceleration of the arrow and the inertia of the slug cause the slug to break free of the magnetic attraction with the hooks and the second magnet, and the slug will move forward in the cavity and pass between the cams of the blades. The blades will be thereby forced by the movement of the slug along the cams to be projected into the extended position. Furthermore, once the slug has moved forward between the cams, the slug will remain wedged between the cams and thereby prevent spurious retraction of the blades.

BRIEF DESCRIPTION OF THE DRAWINGS

The present invention will be better understood after a reading of the following detailed description taken in conjunction with the attached drawings in which.

DETAILED DESCRIPTION OF A PREFERRED EMBODIMENT

Figure 1:
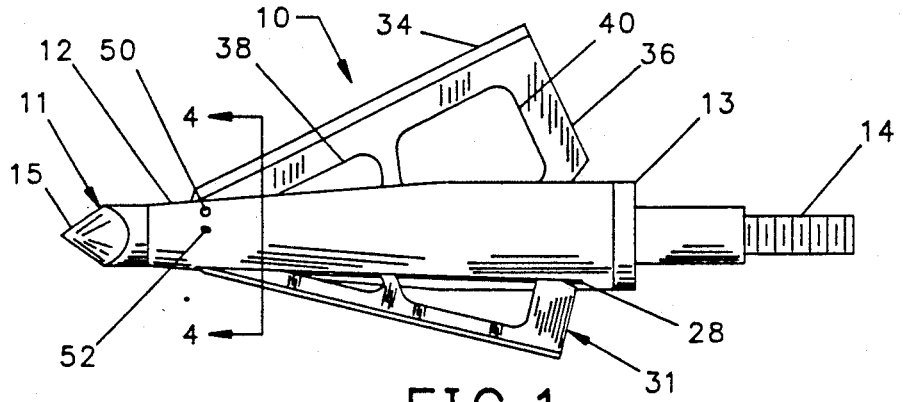
FIG. 1 is a plan view of a broadhead in accordance with the present invention.
Figure 2:
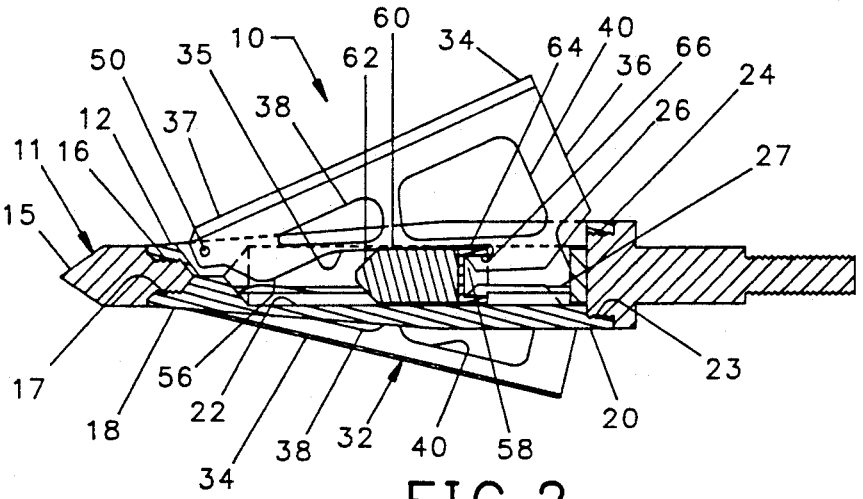
FIG. 2 is a cross-sectional view of the broadhead shown in FIG. 1 with the blades in the retracted position.
Figure 3:
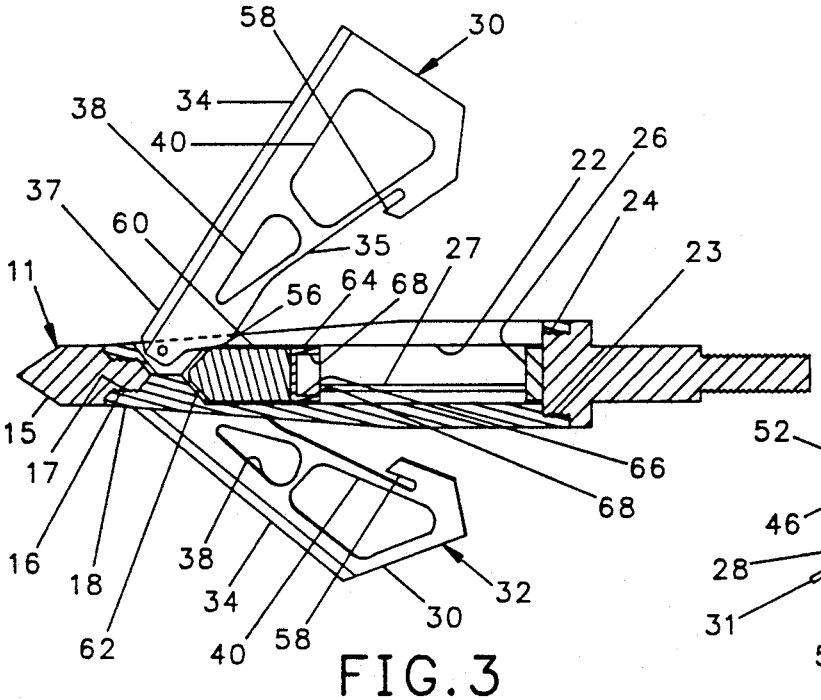
FIG. 3 is a cross-sectional view of the broadhead shown in FIG. 1 with the blades in the expanded position.

Referring to FIGS. 1, 2, 3 and 4, a broadhead 10 has a tip 11, a generally cylindrical body 12, and rearward end portion 13. The end portion 13 is adapted to be attached to the forward end of the shaft of an arrow, not shown, by a threaded stud 14. The threaded stud 14 projects rearwardly along the principal longitudinal axis of the broadhead 10 and is adapted to slide within an aperture in the forward end of the shaft of an arrow and which is complementary in length and width to that of the stud 14 and has threads complementary to those of the stud 14. As best shown in FIG. 2 and 3, the tip 11 has a forwardly directed point 15 and is attached to the body 12 by means of a threaded stud 16 projecting from the rearward end thereof which is adapted to engage complementary threads in an axial bore 17 in the forward end 18 of the body 12.

The body 12 tapers from the rearward end 20 to the forward end 18 thereof and has an axial bore 22 extending from the rearward end 20 through the length of the body 12 and ending adjacent the forward end 18.

The bore 22 is provided with a threaded section 23 extending a short distance into the rearward end 20 thereof which is adapted to engage complementary threads on a cylindrical section 24 on the forward end of the end portion 13, and thereby retain the parts in assemble relationship. The end portion 13 further has a larger cylindrical section 25 coaxial with the cylindrical section 24, and with the body 12. The larger cylindrical section 24 is integral with the cylindrical section 24 and the threaded stud 14 and has an outer diameter equal to the outer diameters of the body 12 and the shaft of the arrow, not shown, so as to provide a smooth outer surface at the joinder of the broadhead 10 to the shaft of the arrow.

Attached to the forward end of the cylindrical section 24 of the end portion 13 is a small cylindrical magnet 26 adapted to easily fit within the bore 22 when the end portion 13 is assembled with the body 12.

Figure 4:
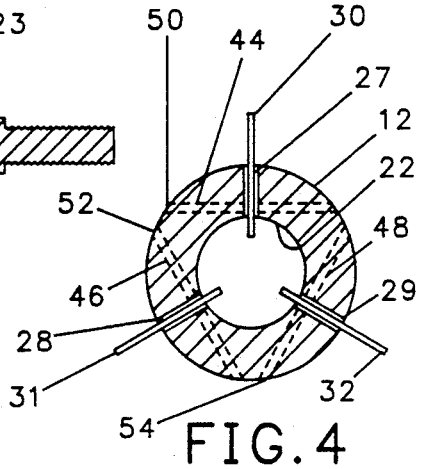
FIG. 4 is an enlarged cross-sectional view of the broadhead shown in FIG. 1 taken through the line 4—4.

As shown in FIG. 4, a plurality of slots 27, 28, 29 are spaced around the circumference of the body 12 and a corresponding number of blades 30, 31, 32 are disposed one within each of the slots 27, 28, 29. The blades 30, 31, 32 are identically shaped and referring to FIG. 2 and FIG. 3, blade 30 is representative of all the blades 30, 31, 32. The blades 30, 31, 32 are generally triangular in shape having a long outwardly facing cutting edge 34, an opposing long inward edge 35 and a somewhat shorter trailing edge 36. The cutting edge 34 and the inward edge 35 converge toward each other at the forward end 37 of the blade 30. A plurality of large apertures 38, 40 in the surface of the blades 30, 31, 32 minimize the surface area of the blades 30, 31, 32 so as to reduce the effect of crosscurrents and drifting of the arrow in flight.

Small apertures 42 at the forward ends 36 of the blades 30, 31, 32 are adapted so that when the blades 30, 31, 32 are positioned with the inward edges 35 positioned within the associated slots 27, 28, 29, they will allign between the sections of correspondingly sized transverse apertures 44, 46, 48 lying in a plane perpendicular to the principal axis of the body 12 which intersects the slots 27, 28, 29. The blades 30, 31, 32 will be retained within the slots 27, 28 29 by pins 50, 52, 54 passing through the small apertures 42 of the blades 30, 31, 32 and the corresponding transverse apertures 44, 46, 48. The pins 50, 52, 54 may be held within the apertures 44, 46, 48 by any suitable means such as a tight fit between the inner walls of the apertures 44, 46, 48 and the outer surfaces of the pins 50, 52, 54. The pins 50, 52, 54 permit the associated blades 30, 31, 32 respectively to pivot from a retracted position with the inward edges 35 projecting between the associated slots 27, 28, 29 as shown in FIG. 2 to an extended position with the free ends of the inward edge 35 withdrawn from the associated slots 27, 28, 29 as shown in FIG. 3.

A cam 56 is positioned along the inward edge 32 adjacent to the forward end 36 of each blade 30, 31, 32. Also a hook 58 is positioned between the cam 56 and the intersection of the inward edge 35 and the trailing edge 36 of each blade 30, 31, 32 and both the cam 56 and the hook 58 are further described below.

A magnetized cylindrical slug 60 having a conical forward end 62 is adapted to fit slidably with the bore 22 of the body 12 and the magnetic field of the slug 60 is oriented to attract the magnet 26 at the forward end of the end portion 13, Behind the slug 60 is a cylindrical catch 64 of magnetic material which is also adapted to fit slidably within the bore 22, and is held securely to the slug 60 by the magnetic force field. The catch 64 has a relatively large cylindrical counter bore 66 in the rear end such that the wall of the catch 64 forms an annular ridge 68.

The body 12 is constructed of a nonmagnetic metal, such as aluminum and therefore the slug 60 will not be magnetically attracted to the walls of body 12 and will slide freely within the bore 22. The blades 30, 31, 32 are made of magnetic material such as steel, and therefore the slug 60 will magneticaly attract the adjacent portion of the inward edges 35 of the blades 30, 31, 32.

As shown in FIG. 2, the ridge 68 on the rear side of the catch part 64 is adapted to receive the hooks 58 of the blades 30, 31, 32 when the blades 30, 31, 32 are in the retracted position and the slug 60 and catch 64 are adjacent the rearward end 20 of the bore 22. The cams 56 are shaped and positioned along the inward edges 35 of the blades 30, 31, 32 such that forward movement of the slug 60 within the bore 22 will cause the conical forward end 62 to move along the edges of the cams 56 and force the blades 30, 31, 32 from the retracted position shown in FIG. 2 to an extended position when the slug has reached the most forward end of the bore 22, as shown in FIG. 3. As the slug 60 move forward within the bore 22, the catch 64 which is magnetically attracted to the slug 60 also moves forward and releases the hooks 58 of the blades 30, 31, 32.

Once the blades 30, 31, 32 are in the extended position shown in FIG. 3, the slug 60 will be positioned between the cams 56 and will thereby hold the blades 30, 31, 32 in the extended position.

To retract the blades 30, 31, 32 from the extended position, the broadhead 10 is positioned with the tip 11 pointed upward and the rearward end is tapped on a hard surface. This is easily done when the broadhead 10 is attached to the forward end of an arrow. Tapping on a hard surface causes the slug 60 to slide slowly downward through the bore 22. The slug 60 magnetically attracts the inward edges 35 of the blades 30, 31, 32 and is prevented from dropping down the bore 22 by it's attraction to the blades 30, 31, 32. As the slug 60 approaches the rearward end 20 of the bore 20, the blades 30, 31, 32 will return to the retracted position, and the annular ridge 68 of the catch 64 will slide over the hooks 58 and lock the blades 30, 31, 32 in the retracted position.

The catch 64 and the slug 60 will be retained adjacent the rearward end 20 of the body 12 by the magnetic attraction of the slug 12 to the magnet 26 attached the end portion 13.

The blades 30, 31, 32 are best made of thin gage steel and precision sharpened. The cylindrical parts are best machined from appropriate metals to reach close tolerance and thereby provide the rigidity needed to withstand the impact of an arrow.

The catch 56 will retain the blades 30, 31, 32 in the retracted position while a hunter manipulates an arrow prior to making a shot. The catch 56 will also retain the blades 30, 31, 32 in the retracted position during acceleration of the arrow as it is released from the bow, and against centrifical force as it rotates during flight. On impact and deceleration of the arrow, the momentum of the slug 60 will cause it to pull free from its attraction with the magnet 26 attached to the end portion 13, and slide forward through the bore 22. As the slug 60 moves forward in the bore 22, the catch 64 will release the hooks 58 on the blades 30, 31, 32 and the slug will engage the cams 56 and force the blades 30, 31, 32 to the extended position. The forward momentum of the blades themselves also contributes to the forces tending to project the blade outward as the arrow decelerates.

While the present invention has been described in connection with a single embodiment, it will be appreciated by those skilled in the art that numberous modification may be made without departing from the spirit and scope of the present invention. It is therefore intended by the appended claims to describe the novel features of the the present invention.

I claim:

1. A broadhead for attachment to the shaft of an arrow comprising in combination:

an elongate body having a longitudinal cavity therein, said body further having a tip end and a shaft end, a plurality of longitudinal slots in said body extending from adjacent said tip end to adjacent said shaft end, a plurality of blades, one blade being received in each of said slots, each of said blades having two opposing edges, one of said opposing edges being a sharp edge and one of said opposing edges being a cam edge, said blades being pivotally mounted within said slots adjacent said tip end of said body with said sharp edges projecting outwardly through said slots and said cam edge extending into said slots, so as to pivot from a retracted position to an extended position, a slug longitudinally slidable within said cavity of said body and adapted to engage said cam edges of said blades when said blades are in said retracted positions and to move said blades to said extended position upon movement of said slug from adjacent said shaft end of said body towards said tip end, and attachment means for attaching said body to the shaft of an arrow.

2. A broadhead in accordance with claim 1 and further comprising:

a hook on each of said blades, a catch on said slug adapted to engage said hooks and retain said blades in said retracted positions when said slug is adjacent said shaft end of said body.

3. A broadhead according to claim 2 wherein said slug is cylindrical in shape and has a rear end and said catch is an annular ridge around said rear end of said slug.

4. A broadhead in accordance with claim 3 wherein said slug is magnetized and said blades are made of a magnetic material and said body is made of a nonmagnetic material.

5. A broadhead in accordance with claim 4 and further comprising a second magnet oriented to magnetically attract said slug and positioned within said cavity adjacent said shaft end of said body.

6. A broadhead in accordance with claim 2 wherein said slug is magnetized and said blades are made of a magnetic material and said body is made of a nonmagnetic material.

7. A broadhead in accordance with claim 2 and further comprising a magnet within said cavity and attached to said shaft end of said body and said slug is made of a magnetic material.

8. A broadhead in accordance with claim 1 wherein said slug is magnetized and said blades are made of a magnetic material and said body is made of a nonmagnetic material.

9. A broadhead in accordance with claim 8 and further comprising a second magnet within said cavity attached to said shaft end of said body oriented to attract said slug.

10. A broadhead in accordance with claim 1 and further comprising a magnet within said cavity and attached to said shaft end of said body, wherein said slug is made of magnetic material.

* * * * *